United States Patent [19]

Matthews et al.

[11] 4,007,577

[45] Feb. 15, 1977

[54] APPARATUS FOR PACKAGING FLUID MATERIALS IN PACKETS

[75] Inventors: Ernest L. Matthews; Ralph E. Matthews, both of Decatur, Ala.

[73] Assignee: Matthews Machine Company, Inc., Decatur, Ala.

[22] Filed: May 22, 1975

[21] Appl. No.: 579,930

Related U.S. Application Data

[62] Division of Ser. No. 474,164, May 29, 1974, Pat. No. 3,923,084.

[52] U.S. Cl. ..... 53/180 R; 53/373

[51] Int. Cl.² ..... B65B 9/08

[58] Field of Search ..... 53/37, 180, 373, 51

[56] References Cited

UNITED STATES PATENTS

| | | | |
|---|---|---|---|
| 3,019,583 | 2/1962 | Sylvester | 53/373 |
| 3,505,776 | 4/1970 | Cloud | 53/51 |
| 3,631,903 | 1/1971 | Huggins | 53/180 X |

*Primary Examiner*—Leon Gilden
*Attorney, Agent, or Firm*—B. B. Olive

[57] ABSTRACT

A high productivity packaging apparatus and method utilize a drum and a plurality of circularly arranged trap chambers, or traps, which communicate and rotate with the drum as an integral, compact unit. During rotation of the drum, the level of material to be packaged is sensed within the drum and material is fed intermittently into the drum by a positive screw feed to replace material withdrawn. Each trap successively draws from the material stored within the drum a unit of material to be packaged, traps the unit, discharges any excess and during continued rotation directs the material toward a trap outlet for discharge at a discharge station in synchronism with the passage of packet containers. The packet containers are formed in a continuous strip of heat settable, coated, sheet material (e.g., paper, which is slit, folded, and transversely or "vertically" sealed at spaced intervals), are opened by use of pressurized air immediately prior to filling, and after filling are longitudinally or "horizontally" sealed and then cut into individual packets. Registration marks on the strip are detected and are used as a means to adjust the location of the formed containers with reference to the trap outlets.

3 Claims, 24 Drawing Figures

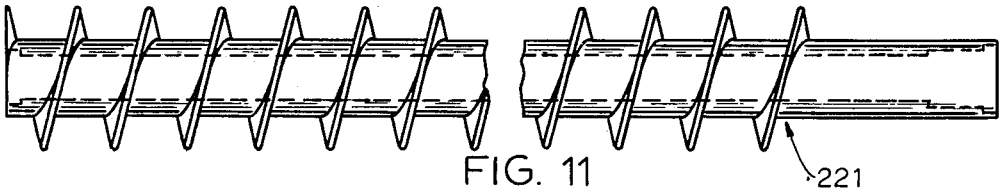
FIG. 11
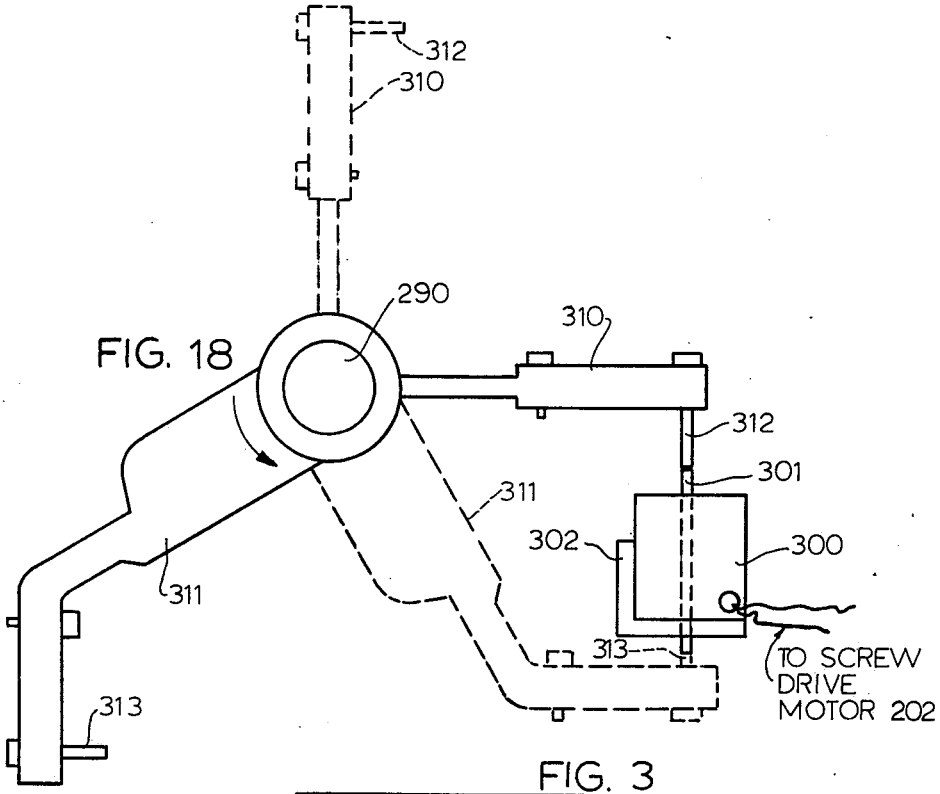
FIG. 18
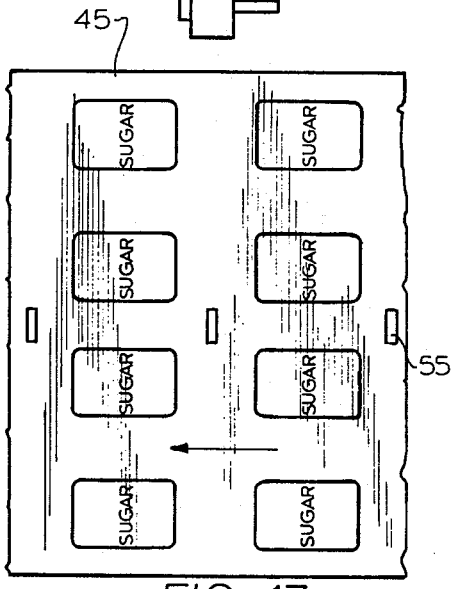
FIG. 17
FIG. 3
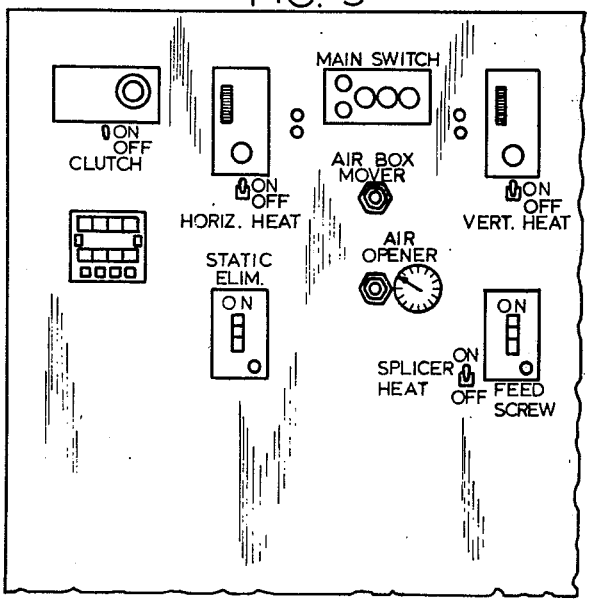

APPARATUS FOR PACKAGING FLUID MATERIALS IN PACKETS

CROSS-REFERENCE TO RELATED APPLICATION

This application is a division of copending application, Serial No. 474,164 now U.S. Pat. No. 3,923,084, entitled "Apparatus and Method for Packaging Fluid Materials in Packets", filed May 29, 1974.

BACKGROUND OF THE INVENTION

1. Field of the Invention:

This Invention pertains to fluid material measuring and dispensing, to the packaging art, and more particularly to condiment-type material packaging apparatus and methods for packaging individual serving type packages of, for example, sugar, salt, pepper, mustard, catsup, and the like.

2. Description of the Prior Art:

U.S. Pat. Nos. 2,653,430, 2,746,223, and 3,344,576 are cited as being merely representative of what is otherwise a voluminous prior art. The prior art apparatus generally is complex, requires substantial space and does not meet the increasing high productivity requirement. It has been proposed as seen in U.S. Pat. No. 3,344,576 to rotate plural material guides, i.e., funnels, which guide the material to the packets while being filled. It has also been proposed to rotate the packets themselves to facilitate filling. One also finds in the prior art various cam actuated operators which sit on the packets and which revolve and assist in the filling, metering or discharge functions which are inherent in any packaging apparatus. Metering is normally accomplished by stationary and relatively complex metering traps.

U.S. Pat. No. 3,578,778 teaches employment of a rotating filling wheel or drum having a plurality of cam actuated trap chambers or traps mounted on the drum periphery and which drum holds the material to be packaged. Each trap fills with material, isolates one or more units of material and discharges material units into synchronized individual packets or containers to be filled. While a marked advance over the prior art, the trap operations have required many moving parts.

U.S. Pat. No. 3,631,903, over which this invention marks an improvement, resides around the concept of maintaining a supply of fluid material to be packaged in a rotatable drum, rotating the drum at some uniform speed in a constant direction, and simultaneously rotating a set of "traps", i.e., metering devices or trap chambers, which are arranged in a circular configuration and which are connected to and which rotate with the drum. Each trap provides an elongated, non-linear, material flow path between an inlet and outlet and in the embodiments disclosed in the patent such path is of helical shape. At a filling station each trap is positioned so that the material to be packaged is drawn from the drum through the trap inlet and so as to locate itself at one end of the helical path. As the valve rotates around the drum axis all material in excess of a unit of material is discharged through the inlet and the rotation causes the unit to move along the helical path and approach the trap outlet. As the trap reaches a separate discharge station, the unit of material reaches the end of its helical path and is discharged in synchronism with a packet or other container to be filled, mating with the trap outlet. Two or more such helical paths and two or more units of material may be discharged simultaneously.

While the packaging apparatus and method described in U.S. Pat. No. 3,631,903 represented a dramatic improvement over the apparatus described in U.S. Pat. No. 3,578,778 and other prior packaging apparatus and methods, use of such apparatus and methods have revealed the need for even further improvements. Specifically, there has developed a need for substantially reducing the length of the run of the packaging paper between the point where the paper leaves the roll supply and the point where the filled paper is cut into individual packets. Such reduction of run length is needed to reduce the possible points of breakdown, to facilitate threading, and to increase production. There has also developed a need to improve the manner in which the vertically sealed containers formed in the paper are opened just prior to entry of the filling spouts in order to insure positive opening and to prevent the spouts missing the containers. Experience with the apparatus and method disclosed in U.S. Pat. No. 3,631,903 has also revealed the need for maintaining registry between the formed containers and other moving components and a need for improvement in the horizontal sealing. While registration apparatus is well known, it has never been applied in a practical way with a filling apparatus of the type described in U.S. Pat. No. 3,631,903. Finally, there has proven to be a need for improving the spout shape and for providing a more positive method of feeding the material, e.g., sugar, into the dispensing drum and maintaining level control.

SUMMARY OF THE INVENTION

The apparatus and method of the invention constitute improvements particularly upon the apparatus and method of U.S. Pat. No. 3,631,903. The present invention constitutes a number of specific improvements which collectively provide a substantially improved packaging apparatus and method over that described in U.S. Pat. No. 3,631,903. While the drum filling portion of the invention is applicable to packaging bottles, paper cartons, and the like, the description is directed to forming packets in a pliable sheet and packaging sugar and the like in such packets. From this description the broader applications of the new screw feed, filling drum and level control will be readily appreciated by those skilled in the art.

In substance, the present invention reduces the length of run of the packaging paper, provides a means for maintaining registration of the packaging paper and particularly the vertical seal locations, utilizes an air suction device for positively opening the vertically sealed packets just prior to their being filled, provides a more compact filling drum structure than previously provided, provides an improved filling spout, utilizes a substantially improved horizontal sealing apparatus and method, provides a unique level control and, most importantly, provides a means for positively replenishing material in the drum at a controllable and uniform rate.

The registration system of the invention detects registration marks on the packaging paper prior to the paper being vertically sealed and then causes the paper effectively to move or drift with reference to the vertical sealer and in either direction as required so that accurate forming of the vertical seals is obtained. The mentioned air opening device is designed effectively to suck the sides of the vertically sealed packets apart just prior to the packets receiving the filling spouts. Compactness of the filling drum is obtained by forming the traps as part of the filling drum itself rather than by forming them separately and attaching the traps to the drum periphery as taught in U.S. Pat. No. 3,631,903. A pair of communicating sloped and horizontal screws are used to elevate the sugar or other material from a storage bin and transfer it into the filling drum as required. The level control utilizes an improved oscillatory paddle and switch arrangement. The paddle senses the material level, rotates a shaft on which the paddle is mounted, and actuates a switch which energizes a screw drive motor, causing the material supply screws to operate when and as needed. The required horizontal seal is effected by an improved sealing apparatus and method designed to cause the horizontal paper surfaces requiring sealing to be sealed and to move back and forth between heated surfaces having constantly changing curvatures. The overall effect of the invention improvements is to provide a machine capable in its design speed of exceeding 2500 packets per minute based on forming two packet strips simultaneously and which in actual practice has maintained a production rate of 2000 packets per minute. It has thus become the primary object of the present invention to reduce the length of the paper run, make the paper easier to thread, improve the opening operation, improve the final horizontal sealing, improve the spout shape to improve filling, improve the material feeding from the main storage bin to the dispensing drum and to improve the construction of the dispensing drum and reduce its size. In substance, the object is to provide a vastly improved packaging machine and method of packaging, and the various improvements will be seen as the description proceeds.

DESCRIPTION OF THE DRAWINGS

FIG. 3 is an enlarged front elevation view of the packaging apparatus control panel.

FIG. 11 is a side elevation view of a horizontal screw used by the invention in supplying material to the drum.

FIG. 17 is a plan view of a section of the paper used in packaging the material and which is shown prior to being slit.

FIG. 18 is an enlarged end elevation view of a switch arrangement used to control the supply of material to the drum and filling spouts.

DESCRIPTION OF THE PREFERRED EMBODIMENTS

A high production packaging apparatus and method according to the invention will now be described in reference to the appended drawings. Various commonly used frame bracing members, and the like, have been eliminated to simplify the drawings. Also, details of the electrical wiring, controls, switches, and the like, have not been shown but are described sufficiently to enable those skilled in the art to practice the invention.

Figure 1:
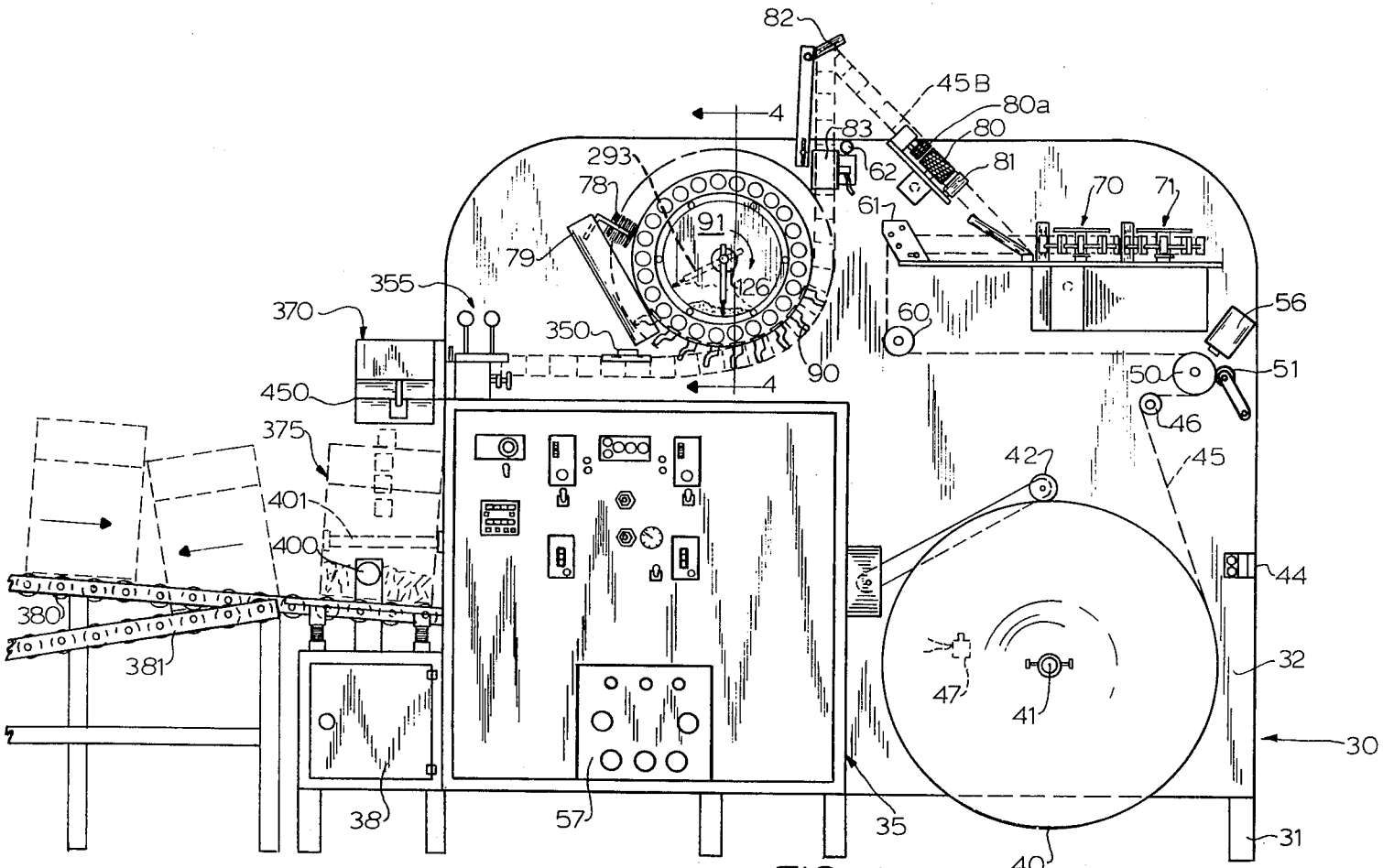
FIG. 1 is a front elevation view of the preferred embodiment of the packaging apparatus.
Figure 2:
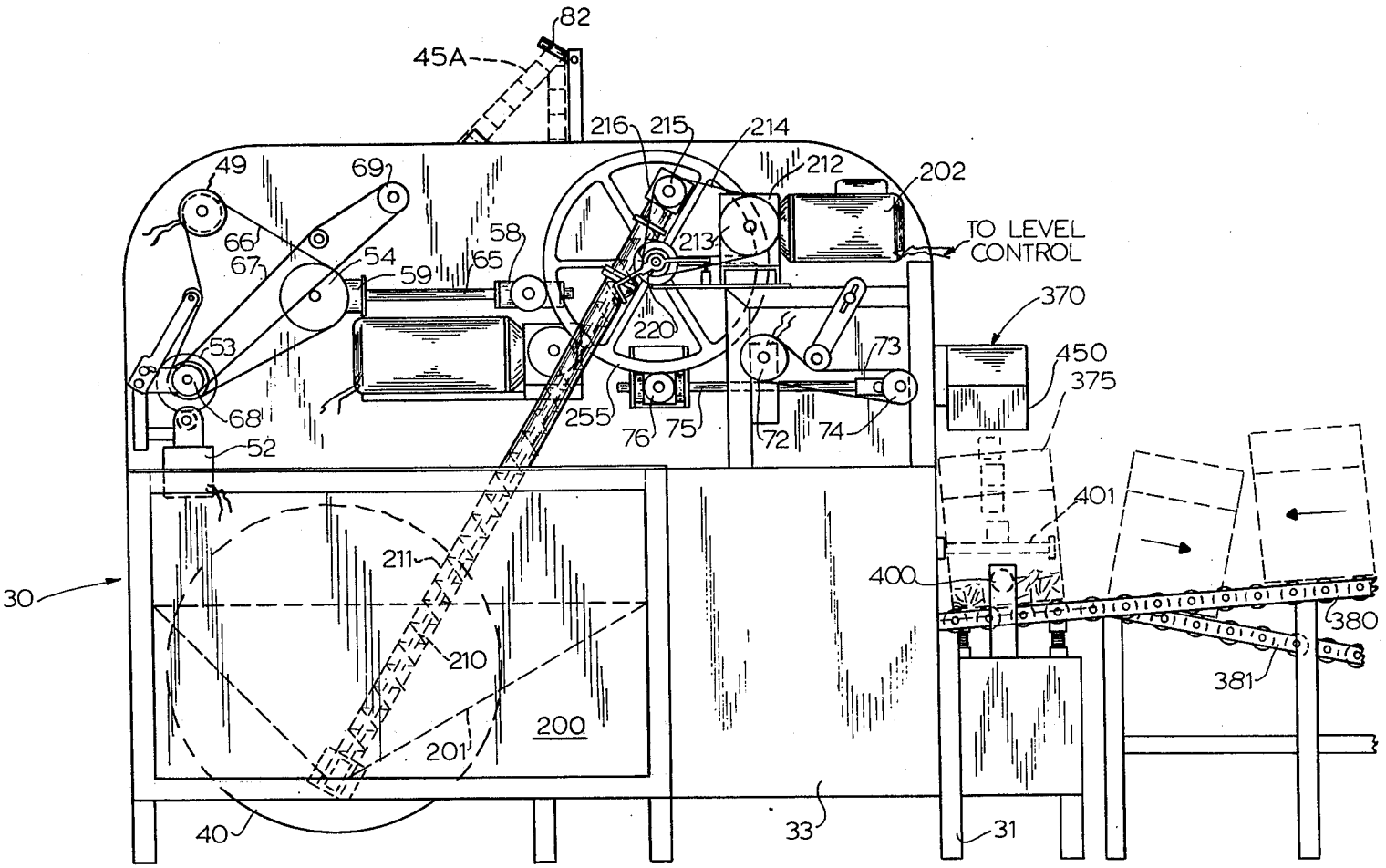
FIG. 2 is a rear elevation view of the packaging apparatus of FIG. 1.

The packager frame 30 consists of welded construction and as illustrated in FIGS. 1 and 2 is provided with floor mounting feet 31, a front reinforcing panel 32, a rear reinforcing panel 33 (shown in FIG. 2), a control box 35, and an inspection door 38.

While, as later described, individual bottles, paper cartons, and the like, may be employed with the drum filling portion of the invention, the apparatus and method of the invention are specifically directed at the type of packaging used for forming individual packets or serving-type packages from heat settable paper, or the like, such as used for sugar, salt, pepper, mustard, catsup, and the like. There is provided a heat settable, coated paper roll supply 40 mounted for rotation on an axle 41 having a weighted drag roll 42. The packet-forming paper 45 passes from the roll supply 40 over an idler guide 46 to a driven roller 50 which will be referred to as the bottom driven roller. The driving arrangement for bottom driven roller 50 will be described later in connection with FIG. 2. A weighted idler roll 51 prevents slippage of paper 45 around bottom driven roll 50. Idler roll 51 can be flipped back out of contact with roll 50 when the machine is being threaded. The paper 45 may be imprinted with appropriate advertising which may be used for registration purposes, or preferably, the paper is printed with longitudinally spaced registration marks 55 (FIG. 17) which may be detected by a registration optical detector 56 and through appropriate registration controls 57, later explained, used for purposes of registration. An electrically heated bar 44 is provided for sealing the trailing end of a used roll to the leading end of a new roll. Bar 44 may be energized by a suitably placed switch 47 which is actuated by the drag roll 42 moving to a position corresponding to a depleted roll and which speeds up installation of a new roll. Switch 47 may also be used to actuate a warning signal and to stop the filling operation in the event the depleted roll is not observed by the operator.

Figure 12:
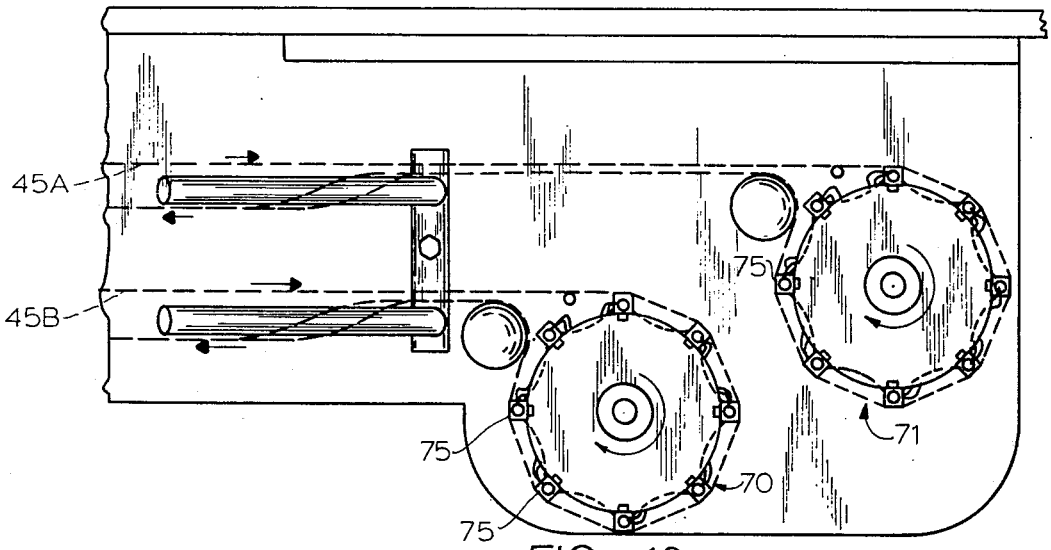
FIG. 12 is a fragmentary plan view of the vertical sealer arrangement and the paper-turning device.

To continue following the path of the paper in FIG. 1, the paper next passes over an idler roll 60 and then through a slitter-folder 61 which causes the paper to be slit into two half-sections 45*a* and 45*b* for each half-section and folded as indicated in FIG. 12. Here it should be understood that a single width paper could be employed and which would eliminate the use of slitter folder 61. For the purpose of the present description, the use of a double width paper has been chosen though it should be understood that by duplicating the paper handling, sealing, filling, and cutting apparatus hereafter described, paper suitable to making up more than two packet-forming strips could be employed throughout the system being described.

Since the general practices of slitting, vertically sealing, filling, horizontally sealing and cutting individually filled packets are already known, the description will primarily describe in detail those parts of the apparatus and steps of the invention which are deemed novel and not apparent to those skilled in the art. In this regard, U.S. Pat. No. 3,631,903 furnishes useful background.

Figure 13:
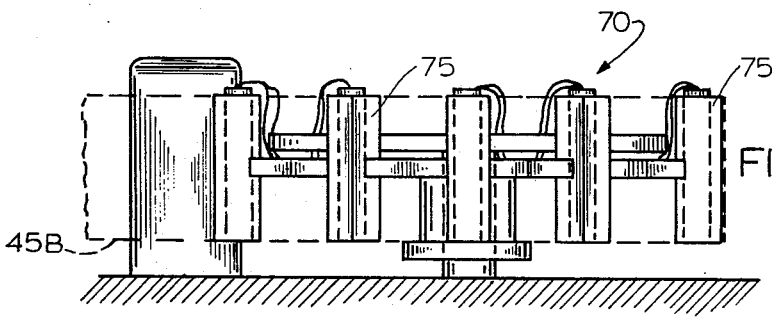
FIG. 13 is an enlarged side elevation view of one of the vertical sealer heads of FIG. 12.

As best shown in FIGS. 1, 12 and 13, the slitted and folded paper strips 45*a*, 45*b*, after leaving a slitter-folder 61, are caused to pass over respective vertical sealing units 70, 71 such that strip 45*a* is caused to be vertically sealed by vertical sealer 71 and strip 45*b* is caused to be vertically sealed by vertical sealer 70. The common problem of static electricity may be reduced by use of a conventional static eliminator bar 62 (FIG. 1). Since the slitters, folders, and vertical sealers referred to are well known, no detailed explanation of either is deemed to be required. In general, the vertical sealers 70, 71 are conventional and each constitutes a wheel-like arrangement on which are mounted a plurality of electrically heated sealing bars 75. As the respective heat sealable paper strips 45*a*, 45*b* move around the positively driven heater bars 75, the so-called vertical seals are formed. The space between each vertical seal eventually constitutes a "container" or "packet" for the material to be packaged.

The now vertically sealed and folded paper strips 45*a*, 45*b* are directed between respective pairs of driver knurled rollers 80 which are duplicated for each paper strip which is folded and which will be referred to as the top driven rollers and which are between pairs of smooth surfaced fixed rod guides 81. Smaller knurled idler rollers 80*a*, under spring load, fit against larger rollers 80. Rollers 80*a* are spring loaded so that they may be backed off from rollers 80 when threading the paper between rollers 80, 80*a*. Rollers 80, 80*a* are preferably hardened to reduce the effects of wear and it is desirable that a constant tension be upon the paper strips 45*a*, 45*b* as they pass around the respective vertical sealers 70, 71. Constant tension upon strips 45*a*, 45*b* allows for quick and complete penetration of heat and facilitates obtaining a satisfactory vertical seal. Rollers 80 are preferably slightly overdriven through a slip clutch in order to maintain proper tension. Each paper strip continues its respective path over smooth surfaced rod guides 82 and each paper strip 45*a*, 45*b*, prior to being filled, enters a unique air opening device 83 which is shown in more detail in FIGS. 14, 15, and 16. It should be understood that for each paper strip there will be provided one such air opener 83 whose purpose is that of opening the now formed vertically sealed packets just prior to their moving to the position where they are to receive the material to be packaged, e.g., sugar.

Figure 14:
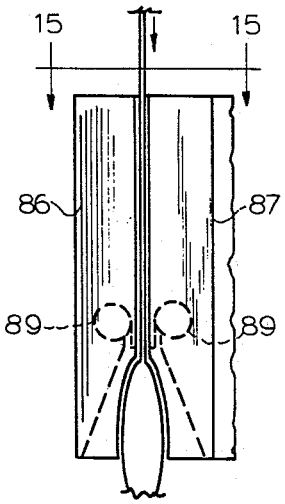
FIG. 14 is an end elevation view of an air opener used in this invention, two such openers being used in the embodiment described.
Figure 16:
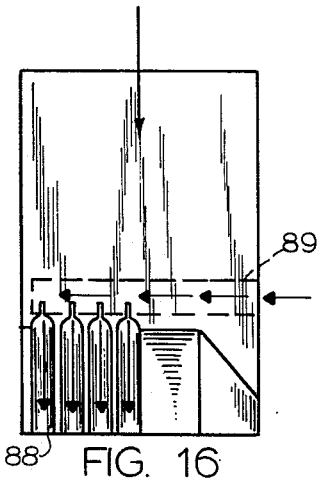
FIG. 16 is a plan view of the interior face of one of a pair of identical plates which make up the air opener.
Figure 15:
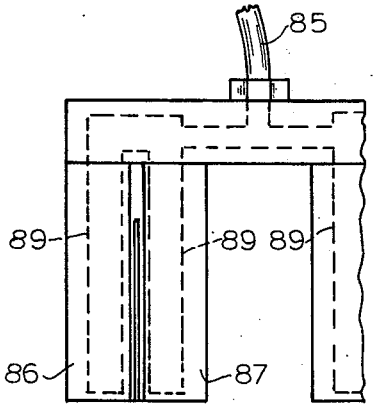
FIG. 15 is a plan view of the device of FIG. 14 and illustrating the air supply for the openers in a dual arrangement.

With specific reference to FIGS. 14, 15 and 16, each air opener 83 is provided with a suitable pressurized air supply through an air-supply tube 85. The exact pressure is not critical and a suitable pressure can be obtained simply by observing the opening under a stroboscopic light and adjusting the opening and pressure to obtain the desired opening effect. The opener consists of a pair of spaced blocks 86, 87 having a plurality of formed depressions 88 which communicate with an air channel 89 which in turn receives air from air supply tube 85. Aluminum blocks have been used but many other materials such as plastic, glass, or the like, could be similarly formed. As the folded and vertically sealed paper strip passes downwardly through the respective air opener 83, the sides of each packet container formed between each pair of vertical seals tend to be sucked outwardly towards the respective plates 86, 87 and which in turn tends to open the container. This is due to the venturi effect of the air exiting depressions 88 on the sides of each packet. As the sides of the packet are thus sucked outwardly, the mouth of the packet is caused to open and each paper strip 45*a*, 45*b*, after leaving its respective air opener 83, is time to cause the mouth of each respective opened packet to engage a respective filling spout 90 on the filling drum 91. Thus, each packet and its respective filling spout are assured of coming together in a positive engagement with each respective spout properly seated in its packet.

Figure 5:
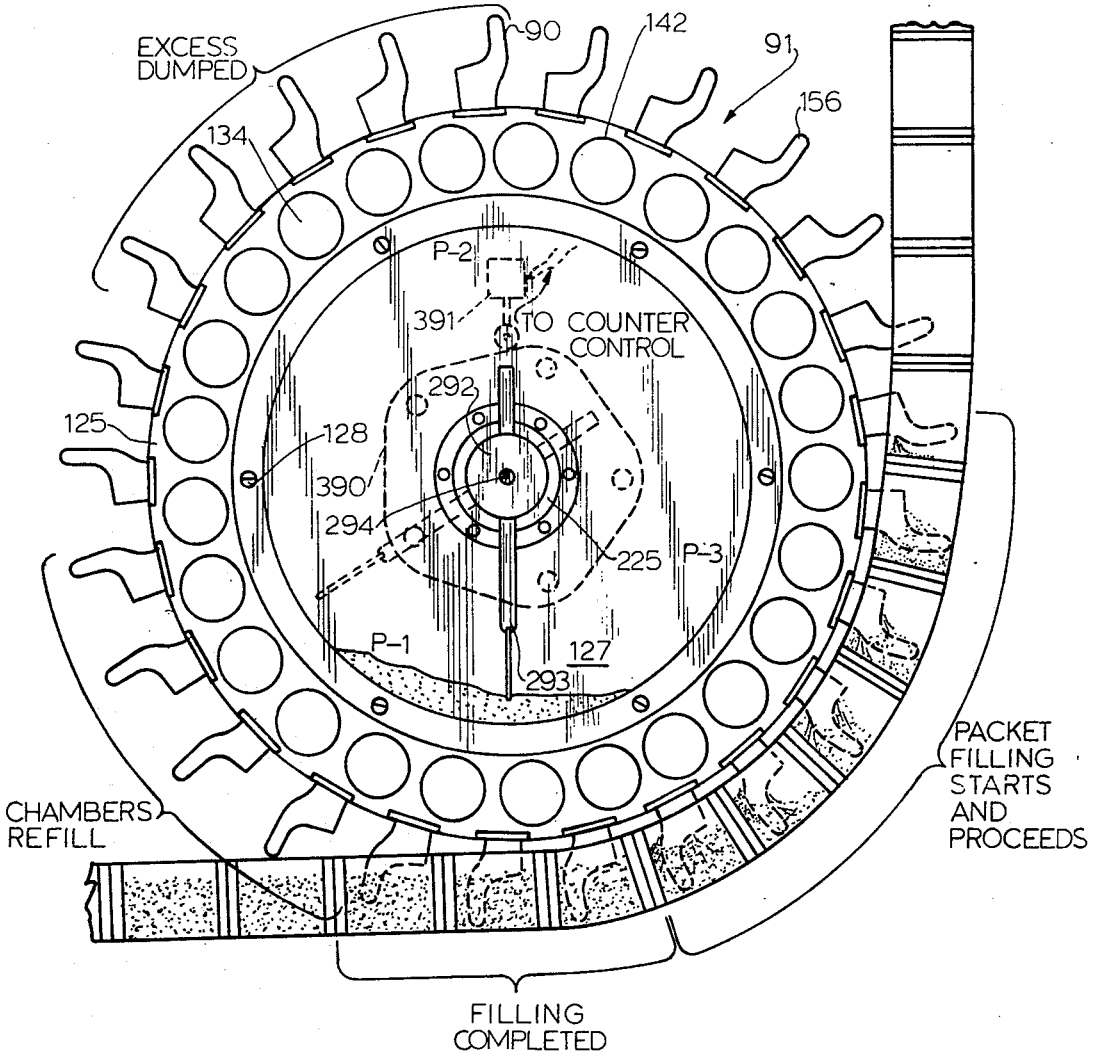
FIG. 5 is an enlarged front elevation view of the filling drum section and the filling spouts around the drum.

As can best be seen in FIG. 5, the inner and outer edges of the respective folded packet strips which pass position P-3 are caused to be bent or curved so as to generally follow the curvature of the drum as the strip packets move past position P-3 and around the horizontal axis of the drum 91. This method of handling the portions of the packet strips being filled has been found in practice to assist in puckering and opening the packets for filling. For example, with a drum outside diameter of about 16¼inches, a filling spout depth of about 2 inches, and a folded packet width of about 1¾inches, the packet strips in practice can be seen to pucker and open when moving in the arcuate path depicted in FIG. 5. The inner and outer edges of the respective packet strips, while depicted as smooth curves in FIG. 5, will, of course, have some wrinkles conforming to being curved as shown.

The body 125 (FIG. 4) of drum 91 is of one piece, panshaped, cast metal construction and has its front face covered by a transparent cover plate 127 which is secured by the screw 128 to provide a hollow drum or container for the material. The body 125 is affixed to the bearing tube 222 by means of screw 250, as later referred to, and is concentrically mounted with respect to its axis of rotation by means of bearings 251, 252. The external peripheral wall 130 of the body 125 is provided with externally machined surfaces 131 (FIG.

6) on which are mounted the uniformly and peripherally spaced spouts 90 by means of screws 132 and which are associated with the metering and dispensing trap chambers 120.

Here it should be understood that the word "trap" or "trap chamber" is used somewhat arbitrarily since, as later described, the "traps" of the invention have no moving parts and do more than provide a flow path. The traps of the invention act in fact as a means for receiving, metering, guiding, and discharging units of material on each rotation of drum 91.

The metering and dispensing traps 120 and their associated spouts 90, which are shown in greater detail in FIGS. 4 through 10, are adapted to package two packets simultaneously; however, more or fewer packets may be packaged with the appropriate modifications to the apparatus. The "packets" are preferably in continuous strip form, as in FIGS. 1, 5, 12 and 13. However, discrete containers such as bottles or boxes, not shown, may be used with the drum or filling wheel portion of the invention apparatus.

Figure 6:
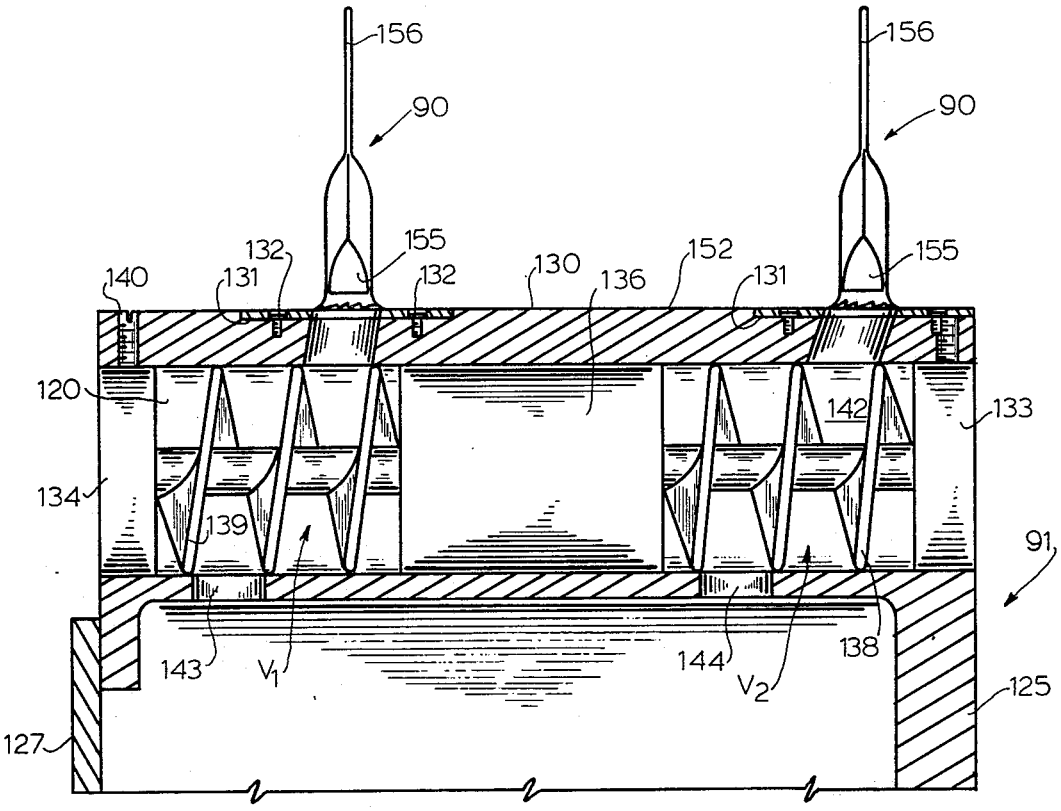
FIG. 6 is a fragmentary enlarged section of one of the trap measuring devices around the drum periphery.

Each metering and dispensing trap 120 is formed with a hollow, cylindrical opening 142 whose ends are closed by circular nylon discs 133, 134 held by set screws 140 (FIG. 6). Openings 142 are formed by equally, peripherally spaced holes bored through the cast-metal body 125 of drum 91. This construction both reduces construction and maintenance costs and lends itself to a more compact drum arrangement as contrasted with the traps which are separately formed and secured to the drums as taught in prior art Patent 3,631,903. A cylindrical spaced block 136 is snugly fitted and centered in the interior of opening 142 and effectively divides opening 142 into two independent trap sections $V_1$ and $V_2$. A pair of snugly fitted helical screws 138, 139 are located on opposite sides of spacer block 136. Screws 138, 139 provide respective helical flow paths for the material. Material is fed to trap section $V_1$ through inlet 143 and to trap section $V_2$ through inlet 144. Block 136 and screws 138, 139 are of nylon. While described as separate items, discs 133 and 134, screws 138 and 139, and block 136 are preferably molded from nylon as a single integral part for each trap assembly.

Inlets 143, 144, of course, communicate with the interior of drum 91 and as drum 91 rotates the material residing inside drum 91 is forcibly injected into the trap inlets 143, 144 by gravitational and centrifugal forces.

Figure 9:
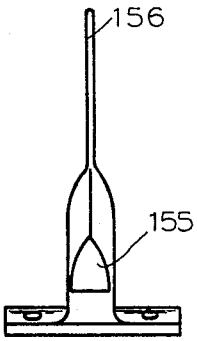
FIG. 9 is a rear elevation view of the device of FIG. 7.
Figure 8:
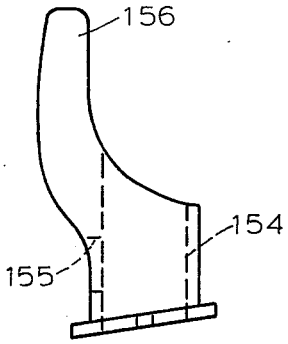
FIG. 8 is a side elevation view of the device of FIG. 7, the side not shown being a mirror image thereof.
Figure 7:
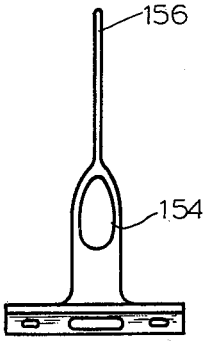
FIG. 7 is a front elevation view of a filling spout employed in this invention.
Figure 10:
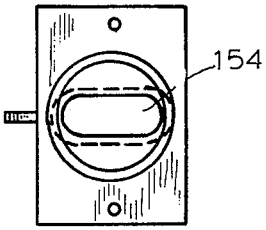
FIG. 10 is a bottom view of the device of FIG. 7.

Further improvements are provided in the packet filling spouts 90 which serve as respective outlet ports for trap sections $V_1$ and $V_2$. Filling spouts 90 are thin walled, tubular members which are flush mounted with the outer surface 152 of the drum body 125 and project from the drum body a sufficient distance to insure entry into the packet, bottle, box or other container without the loss of any material being transported thereby. While the filling spouts may, of course, be shaped to conform to the particular type of container being packaged, FIGS. 8-10 show a preferred embodiment for packaging sugar and the like.

In particular, each spout 90 provides for the material to be expelled both through central, axially extending port 154 (FIG. 8) and a lateral port 155 which communicates with port 154 proximate the drum body 125. Each spout 90 also includes a rigid, thin, tip portion 156 which first engages the packet opening which, as drum 91 rotates (see FIG. 5), gradually inserts itself into the near full depth of the packet. The wider portion of the spout 90, containing ports 154 and 155, is also at this stage inserted into the packet and material will normally first pour through lateral port 155 and then through axial port 154 until the measured amount has been drawn. Such arrangement insures positive spout-packet engagement and also insures a positive and quick discharge which maximizes the drum speed and packaging rate.

The operation of screw members 138, 139 follows the teaching of U.S. Pat. No. 3,631,903 but for a better understanding of the improvements related to the present invention it will be shown how they act to receive the material, measure out units of material, and then dispense the respective units of material through the improved filling spouts 90. In this regard, it will be noted that when the trap is in the position P-1, FIG. 5, the left ends of the screws 138, 139, as seen in FIG. 6, will fill through the respective inlets 143, 144. As the trap moves on to position P-2, the trap is inverted and excess material is dropped back into drum 91 through inlets 143, 144. At the same time, other material, by reason of the spiral screw effect, is trapped in the respective turns of the screw members 138, 139 and is advanced axially in the direction of the respective filling spouts 90. It is this trapped material that now constitutes a measured material unit in each respective trap section $V_1$, $V_2$. As the trap continues to rotate around the axis of drum 91, it will be noted that the spiralling screw action will continue to advance the trapped material axially in each respective screw member 138, 139. Once the trap reaches the position P-3 or thereabouts, the trapped unit of material in each respective screw member 138, 139 will have been advanced to the point that it reaches the respective outlet and is free to pour out of the respective filling spouts 90. At the same time, new material begins to pour into the respective inlets 143, 144 for screw members 138, 139, but the new material, because of the respective screw member positions at P-3, remains isolated from the material being dispensed. As the trap moves on again to positions P-1, P-2, and back to P-3, the cycle, of course, repeats. Thus, each trap section $V_1$, $V_2$ receives, measures off, stores, and discharges a unit of material on each rotation. Of particular interest to the present invention is the fact that the improved trap construction, improved air opener, improved spout construction, improved horizontal sealing, improved registration, improved material feeding and sensing of the present invention all adapt themselves to utilizing the screw trapping concept at substantially higher production rates than heretofore obtained.

So long as the drum 91 rotates at some uniform speed and is kept filled to some predetermined level of material, as later explained, the traps will sequentially fill, dump excess material and move to the respective filling spouts 90, predetermined units of material which will always be of uniform amount. It can also be seen that the material "unit" is determined by the diameter, pitch, blade thickness, speed of rotation and nature of material, which factors, once determined and fixed, insure a uniformity in measuring the respective units. Further, simply by changing the pitch or diameter of the screw being employed, the volume in the material unit can be changed and in some cases simply by speeding or slowing rotation, the volume in the material unit can be changed. A brush 78 and excess material guide 79 are employed to remove any excess material which clings to the spouts 90 prior to their moving back to a filling position.

Drum 91, of course, always rotates in the same direction and the speed of rotation while constant for a given material is preferably adjusted to the nature of the material. That is, to gain maximum advantage of both gravitational and centrifugal forces, the speed should be adjusted to be sufficiently fast so that the trap tends to fill in excess of one unit of material on each rotation, with the excess being eliminated by the fact that each respective trap when it inverts to position P-2 will retain only one unit of material. Some paste-like and semi-liquid materials, therefore, may be found compatible with the apparatus and method of the invention though they may require a different range of speed than is required for liquid and granular materials and in some cases the materials are expected to be heated and dried as part of the packaging process.

The improved screw conveyor system for storing and transferring the material prior to introduction to the drum forms an important part of the present invention. Reference is made to U.S. Pat. Nos. 3,578,778 and 3,631,903 over which the present invention represents an improvement. In the apparatus and method of these patents it will be noted that the material is elevated from a storage bin to an auxiliary hopper and is then fed directly to the drum by gravity through a pipe which connects the hopper with the drum interior. Such an arrangement has worked, but it has required the use of vibrators and has been found sensitive to changes in humidity when handling sugar and similar granular material. Also, the sugar, for example, cannot always be fed into the drum at the same rate since the amount of sugar vibrated loose in the hopper is subject to many variables. This aspect of the present invention thus seeks to provide for more positive feeding and control over the material fed to the drum.

A storage bin 200 of welded metal or other suitable construction is employed. Appropriate sloping walls 201 provide a limited volume base to facilitate pick-up, and rest on the floor. Storage bin 200 is affixed to the machine frame 30 by suitable frame means and the operator dumps into bin 200, as required, material to be packaged which may be, for example, 100-pound bags of sugar.

The manner in which the material is elevated from the storage bin 200 to the level of the filling drum 91, the manner in which the material is then transferred into the filling drum and the manner in which a predetermined level is maintained in the filling drum 91 all constitute coordinated and important aspects of the invention. In particular, there is provided a vertically sloped and positively driven screw 210 which mounts within a tube 211 which extends into the limited-volume base of the storage bin 200. A suitable driven motor 202, through a right angle gear drive 212, turns a gear 213 which drives a chain 214 which in turn drives a gear 215 which through another right angle gear drive 216 causes screw 210 to rotate whenever motor 202 is energized. It will also be noticed that chain 214 drives a gear 220 which rotates a separate horizontal screw 221 (FIGS. 4, 11 and 23) mounted inside a horizontal tube 222 which at its material recovery end communicates with tube 211. Thus, when screw 210 is turning, the material to be packaged, e.g., sugar, is transferred upwardly from bin 200 by vertical screw 210, is then transferred to screw 221 and is then moved horizontally towards the filling drum 91 where it exits through a perforated cap 225. Here it can be seen that by properly designing the screws 210 and 221 and controlling and synchronizing their speeds, the sugar or other material can be drawn from bin 200 in positive measured amounts and lumps can be broken up in transit. Thus, by sensing the material level in drum 91, as later explained, replacement material can be drawn into drum 91 as needed at a substantially uniform rate. Also, this method of replenishing drum 91 allows drum 91 to move at a relatively high rate of packaging since material replenishing can be done positively and at a fast rate.

Figure 4:
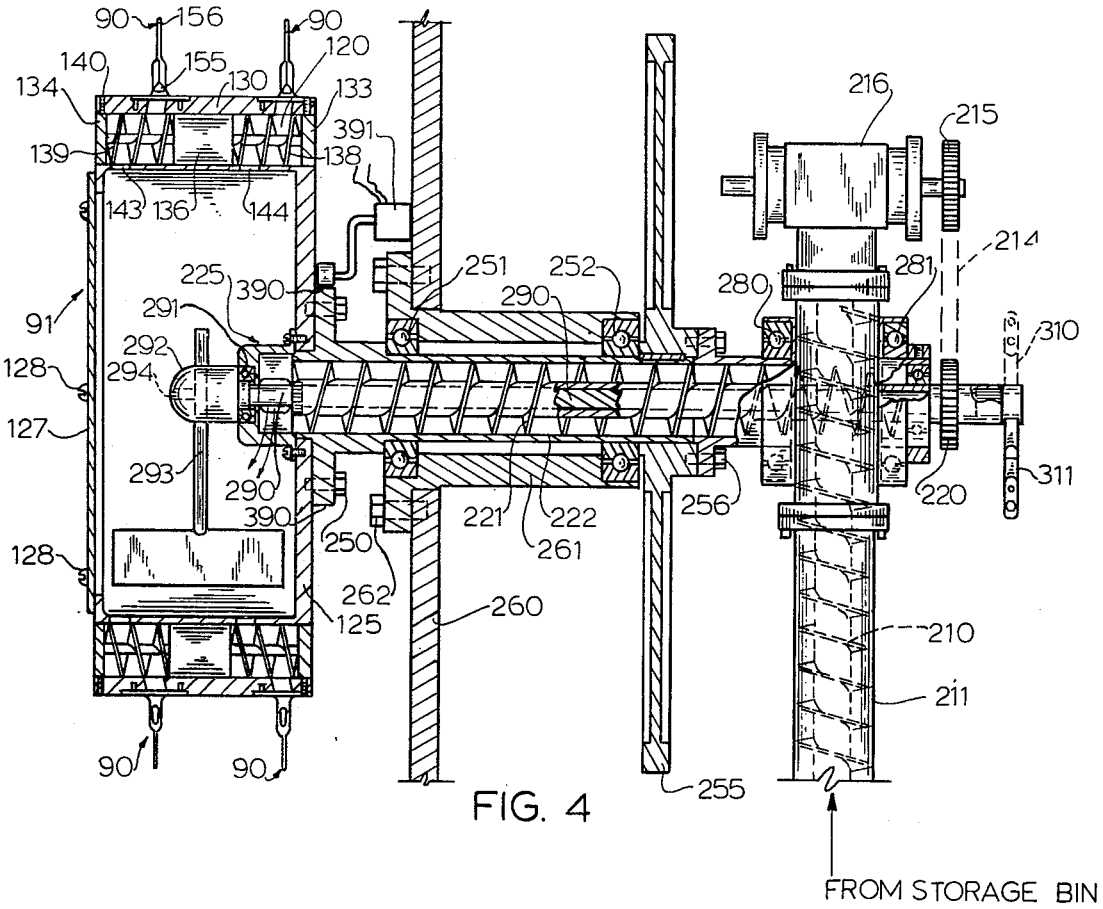
FIG. 4 is a fragmentary section view taken on line 4—4 of FIG. 1.

Tube 222 is secured on its discharge end to drum 91 by means of bolts 250, as best shown in FIG. 4. Tube 222 is also rotatably supported by bearings 251, 252 and at its opposite end is secured to the drive gear 255 by means of bolts 256. Bearings 251, 252 are in turn supported by frame member 260 and hub member 261 which is secured to frame member 260 by bolts 262. Turning of drive gear 255 thus causes drum 91 to rotate. However, conveyor screw 221 is connected to be separately driven by means of gear 220 which mounts on conveyor screw 221 and is driven by chain 214 through gear 213. Added bearing support for the tube 222 is provided by bearings 280, 281. What should be appreciated here is that this coaxial drum-screw arrangement allows drum 91 to rotate continuously and screw 221 to rotate intermittently about the same axis.

Before describing improved level control of material in drum 91, which controls when conveyor screws 210 and 221 operate, a brief review of the conveyor screw operation will be given. In particular, it will be noted that when screw drive motor 202 is energized, both conveyor screw 210 and conveyor screw 221 are caused to operate. Conveyor screw 210 will elevate material from storage bin 200 and transfer it to conveyor screw 221, which will then carry material into drum 91.

Referring next to the level control, it will first be noted that conveyor screw 221 is of a hollow construction as seen in FIGS. 4 and 11. A shaft 290 extends through conveyor screw 221 and is supported by a bearing 291 mounted in cap 225. A cap extension 292 mounts a material level sensing paddle 293 which can be adjusted radially by means of set screw 294. At the opposite end of shaft 290 there is mounted a lever switch arrangement best depicted in FIGS. 2, 4 and 18. To best understand this arrangement and how the level control operates, it is first necessary to observe and appreciate that shaft 290 rotates independently of conveyor screw 221 and also rotates independently of tube 222 which surrounds screw 221 and which drives drum 91. Thus, even though drum 91 may be continuously turning with tube 222, screw 221 can be stationary and at the same time shaft 290 can be stationary. For example, if the machine is being run with no material for test purposes, drum 91 can be caused to rotate while screw 221 and shaft 290 remain stationary. Also, shaft 290 can shift its rotative position while screw 221 remains stationary or shaft 290 can be changing its rotative position at a time when screw 221 is turning.

Referring particularly to FIG. 18, the level control incorporates a two-position microswitch 300 having a two-position switch plunger 301 and supported on a frame member 302. When plunger 301 is depressed, switch 300 is closed and when plunger 301 is elevated, switch 300 is opened. Switch 300 is in circuit with the screw drive motor 202. Thus, when plunger 301 is pushed down, screw drive motor 202 is energized. To further explain this operation, plunger 301 is depressed by means of a lever 310 rigidly secured to shaft 290 and plunger 301 is elevated by means of a lever 311 which is also rigidly mounted on shaft 290. Levers 310, 311 have switch engaging pins 312, 313. Referring to FIG. 1, the paddle 293 (also seen in FIG. 4) is shown in a vertical position corresponding to the drum being empty or substantially empty. In this empty condition, lever 310 wil occupy the solid-line condition shown in FIG. 18 which will cause switch 300 to close, screw drive motor 202 to be energized and the respective conveyor screws 210, 221 to operate and transfer material from bin 200 to the interior of drum 91. As the amount of material in drum 91 increases, paddle 293 will be caused to move in a clockwise direction as seen in FIG. 1 and levers 310, 311 will be caused to move in a counterclockwise direction as seen in FIG. 18 until they move to the respective dotted line positions shown in FIG. 18 whereupon switch 300 will be opened, screw drive motor 202 will be deenergized and the respective conveyor screws 210, 221 will stop turning. As the material is depleted in drum 91, the paddle 293 will return to the vertical position shown in FIGS. 1 and 5 whereupon levers 310, 311 will be caused to move back to the respective solid line positions shown in FIG. 18, switch 300 will be closed and screw drive motor 202 will be energized to cause screws 210, 221 to operate and convey more material to drum 91. Thus during a normal packaging operation, drum 91 will operate continuously, subject only to paper replacement and breakdowns, and paddle 293 will oscillate between vertical and off-vertical positions as drum 91 empties, refills, empties, refills, etc., and motor 202 will switch on and off in the same sequence.

Figure 23:
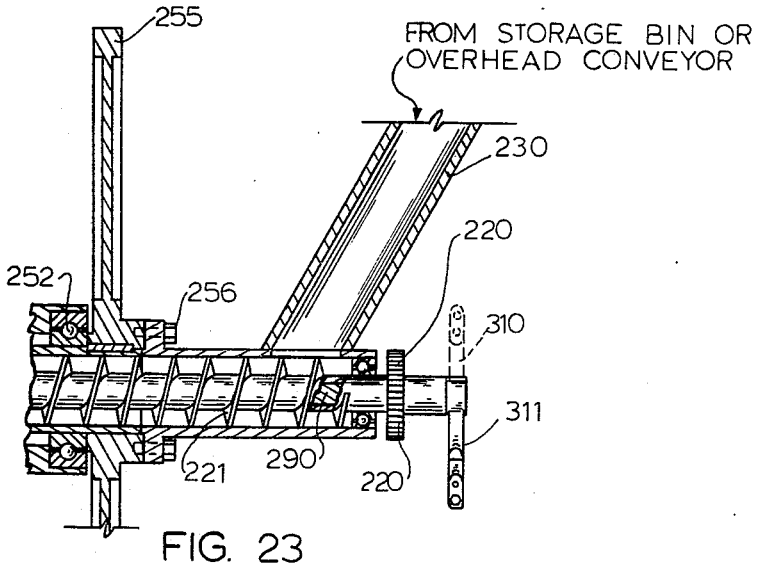
FIG. 23 is a fragmentary elevation section of an alternative means of supply of material to the horizontal screw of FIG. 4.

While it is contemplated that conventional sugar and like packaging practices will dictate use of the dual screw arrangement just described, it is recognized that the material can be fed from an overhead source directly to screw 221 and this embodiment is generally represented in FIG. 23. Here it can be seen that an inlet tube 230 connects directly to tube 222 and thus provides a path of entry for the incoming material. The unique level control previously described nevertheless is equally adapted to this embodiment and would, as required, control the overhead source operation.

To continue with the description, the dual packet strips, after being filled, are passed under a guide 350 and then into a horizontal sealing unit 355 whose details are important to the invention and are later explained. From horizontal sealer 355, the now sealed packets are pulled through a conventional packet knife cutter 370 which is synchronized to cut through the vertical or transverse seals of the dual packet strips and drop the now individual packets into hopper 450 from which they drop to a suitable shipping container 375. As best shown in FIG. 1, the shipping container 375 arrives below the knife cutter 370 on a conveyor 380, is filled below the knife cutter 370 and is then ejected by an appropriate means onto a discharge conveyor 381 for final packaging and shipment. In order to fill each container 375 with the same number of packets, there is provided a cam 390 which is secured and rotates with drum 91, as shown in FIG. 5. Cam 390 operates a counting switch 391 which in turn is connected to a counter control of conventional construction. Since the mechanism for receiving the shipping containers, counting the packets and ejecting the filled shipping containers follow conventional practice, the same are not dealt with in further detail. The mechanism for pushing the shipping container 375 from the incoming conveyor 380 is schematically represented by mechanism 400 and the ejecting mechanism for pushing the filled shipping container 375 onto discharge conveyor 381 is schematically represented by mechanism 401 as best seen in FIGS. 1 and 2. Such mechanisms conventionally use pneumatic rams, or the like, with appropriate controls to perform the described functions.

Referring again to the subject of horizontal sealing, the present invention offers a substantial improvement for packaging sugar, and the like, and accomplishes horizontal sealing in a completely novel manner which substantially overcomes many of the problems encountered in previous horizontal sealers. The past practice during horizontal sealing has been to pass the vertically sealed and filled packets between two heated bars providing narrowly spaced straight opposed heated surfaces. This method has not accommodated to the problem of extraneous grains of material which are often found on the paper surfaces where the horizontal seal is made. Faulty seals are often made and the paper is often burned, resulting in rejected work. Also, maintenance problems have been substantial and particularly since any kind of heated surface which contacts sugar, or the like, requires periodic cleaning under the most ideal circumstances.

Figure 20:
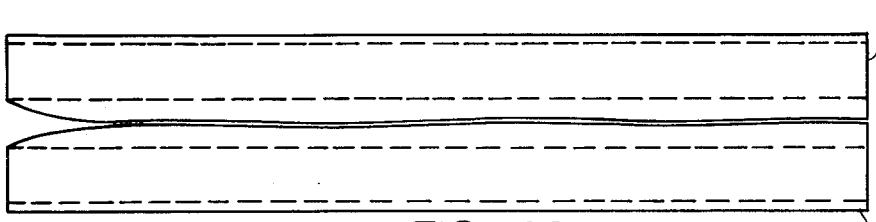
FIG. 20 is a top plan view of one pair of the two wavy sealer plates of FIG. 19 with dashed lines indicating the hollow tubular spaces reserved for the electrical heaters.
Figure 21:
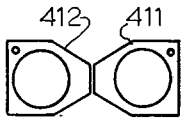
FIG. 21 is an end elevation view of one pair of the wavy sealer plates of FIG. 20.
Figure 22:
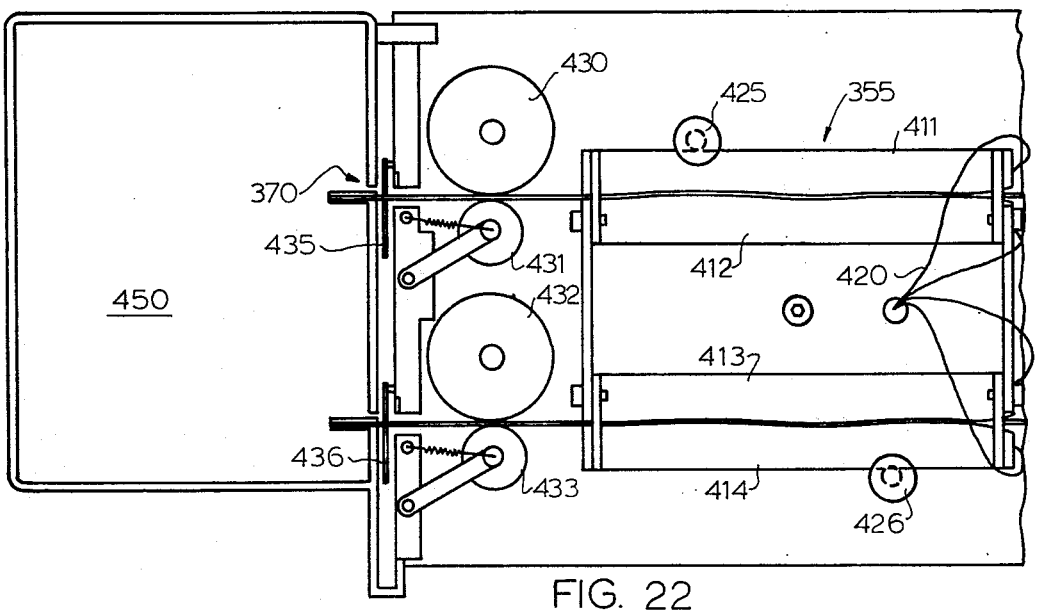
FIG. 22 is a top plan view of the horizontal sealer of FIG. 19 and also showing a cutter arrangement adjacent thereto for severing the filled series of packets into individual packs.

Referring particularly to FIGS. 19–22, there are shown various views of the improved horizontal sealing unit 355 and in FIG. 22 the relation of the sealer to the knife unit 370 is also shown. In particular, the horizontal sealing unit 355 comprises a base structure 410 which mounts on each side respective pairs of sealing bars 411, 412, 413 and 414. Each bar is in effect an electrically heated bar. The mating surfaces of each pair of sealing bars 411, 412, e.g., follow a wavy path as best seen in FIGS. 20 and 22. That is, the paper being sealed is forced into contact with parallel, heated, opposed surfaces of changing curvature. In one embodiment, the contacting surfaces of the bars between which the packet paper is passed and horizontally sealed have heated areas on each bar approximating 6 × ½ inches. Conventional tubular electric heaters are mounted in the hollow interiors of the respective sealing bars 411–414 and are energized by suitable electrical connections 420.

Figure 19:
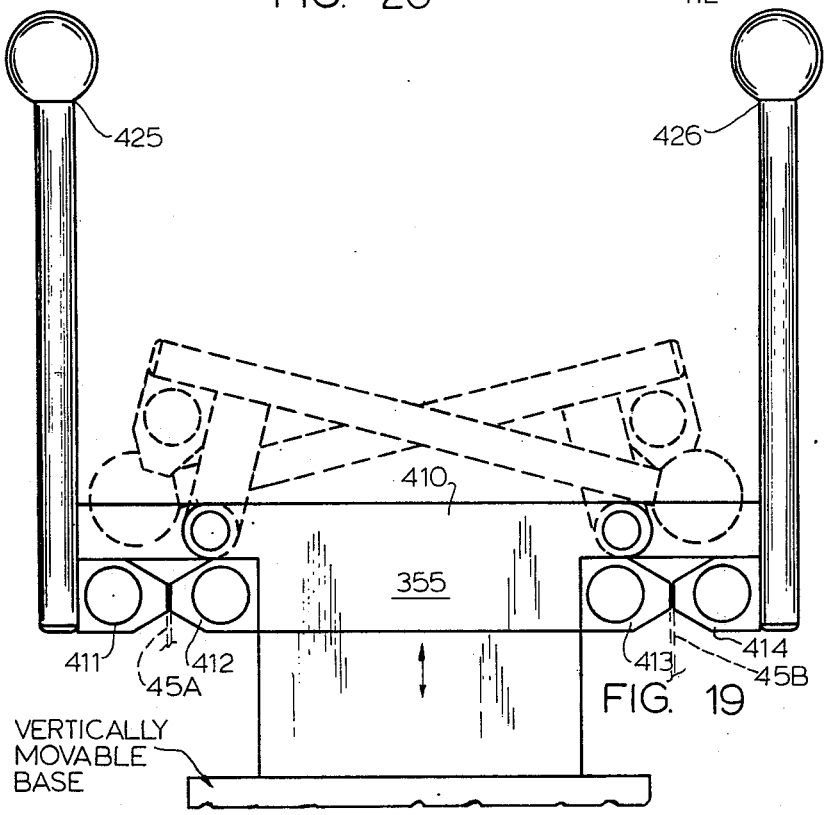
FIG. 19 is an end elevation view of the horizontal, wavy surfaced, heated sealers employed in the invention with the outside sealer bars being shown in dashed lines as for cleaning.

To facilitate maintenance which cannot be avoided when handling sugar, and the like, the outer sealing bars 411, 414 are pivoted as best shown in FIG. 19 and are provided with handles 425, 426 such that when pivoted inwardly to the dotted line positions shown in FIG. 19 the mating heated surfaces are available for cleaning, removal of burnt materials, and the like, such as encountered in normal packaging practice.

The changing bar surface curvatures used in the longitudinal sealers of the present invention tend to minimize packet burning because each side of the packet tends to be in only intermittent contact with a heated bar surface. In contrast conventional straight bar surfaces afford the probability of bringing each side of the packet into continuous contact with a heated bar surface. A further advantage of the longitudinal sealers of the invention is that uniformity in duration of contact between packet and heater surface is assured whereas the straight surfaces of conventional longitudinal sealers permit lateral flutter of the packet strip and, hence, intermittent contact. A still further advantage is seen in the fact that the filling of packets in a packet strip tends to shorten the effective length of the bottom of the strip due to bulging of the packets and consequent concave "pucker" in the outside bottom of said packets, all of which tends to bow the packet strip upward between the filling and cutting operations. The wavy gap between the two halves of each longitudinal sealer employed in the invention counters this tendency by causing the top edge of each corresponding packet strip to assume a sinusoidal shape and hence to effectively shorten the strip.

As best seen in FIG. 22, the packets once horizontally sealed are drawn between respective pairs of driven and idle rollers 430, 431 and 432, 433. The rollers are provided with knurled surfaces to facilitate gripping the paper. The packets then pass the respective knife blades 435, 436 from which they drop into a suitable hopper 450 for packaging into containers 375, as previously mentioned. The usual hopper gate and its mechanism are not shown since the same follow conventional practice.

The register system employed makes use of conventional components of a photoelectric registration system available to the trade but incorporates these components in a unique manner useful to the purposes of the invention. Reference is made to a pamphlet entitled "E.M.P. Model No. 102 Two-Way Preprint Registration Cut-Off Control Systems" and to a pamphlet entitled "EMP Positive, Dependable, Photoelectric Systems For Cut-Off On All Web Fed Machinery," both of which are published by Electronic Machine Parts, Inc., 128–11 18th Avenue, College Point, N.Y. The pamphlets explain the basic operation of the so-called EMP Model 102 two-way registration system which has been found useful for the apparatus of this invention. With the description set forth in these pamphlets in mind, the photoelectric scanner 56, FIG. 1, is connected through the registration controls 57 to a selector switch 49, FIG. 2, and to a registration adjustment motor 52 which controls a mechanical differential 53. The selector switch 49 establishes a correction zone as well as a dwell area between advance and retard and the differential 53 causes the paper to drift in either direction on the vertical sealers as later explained. The vertical sealers 70, 71 are in turn positively driven at a constant speed by gear 54 which in turn is driven by the main drum gear 255 through gear boxes 58, 59 and connecting shaft 65.

The vertical sealer drive gear 54 drives a chain 66 which drives the rotating dial of selector switch 49 and also acts to drive the differential 53. Differential 53 in turn drives through its differential mechanism a chain 67 which drives a gear 68 which drives the bottom drive roller 50 and a gear 69 which drives the top drive rollers 80 shown in FIG. 1.

In operation, the paper registration marks 55 shown in FIG. 17 are detected and, if registration is within defined limits, the bottom drive roller 50 and top drive rollers 80 continue to operate at some predetermined speed and the vertical seals are formed at properly spaced locations on vertical sealers 70, 71. However, if the registration marks lead or lag beyond defined limits, such fact is detected which causes the registration adjustment motor 52 to adjust the differential 53 so that gears 68, 69 either speed up or slow down as required which effectively causes the paper to drift or slide on the vertical sealers 70, 71 which in turn causes a relocation of the vertical seals to their proper positions with reference to the registration marks.

Figure 24:
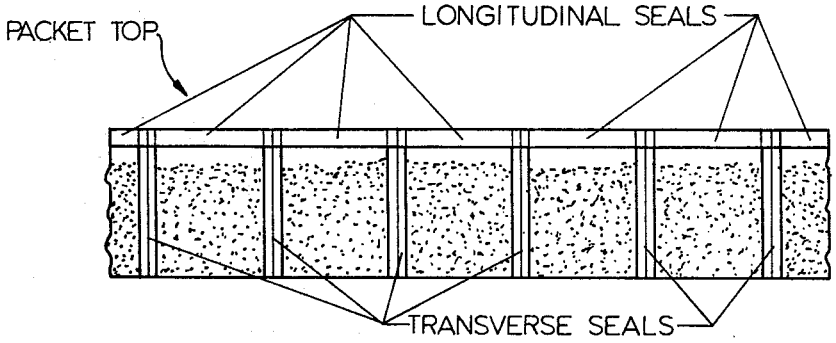
FIG. 24 is a side view of a horizontally and vertically sealed filled packet strip prior to cutting.

Another registration adjustment for the cutting of the vertical seals is also provided in the arrangement which drives the end driven rollers 430, 432 shown in FIG. 22 and which pulls the finished packets just prior to cutting. In this connection, rollers 430, 432 are connected by shaft means, not shown, to be driven through an adjustable magnetic clutch 72, shown in FIG. 2. Clutch 72 is in turn driven by chain 73 off gear 74 which is driven through shaft 75 and gear box 76 off the main drum gear 255. In practice, it has been found that by adjusting the magnetic clutch slippage, the degree of slippage of the paper on rollers 430, 432 can be controlled and this can be used to control the degree of tightness of the paper on the vertical sealers 70, 71 which provides a simple method of controlling the width of the vertical seal. Furthermore, a coarse adjustment of the width or depth of the horizontal seal can be obtained by use of a vertically movable base for the horizontal sealer as schematically illustrated in FIG. 19. Thus, both location and size of the vertical and horizontal seals illustrated in FIG. 24 are adjustable.

The term "vertical seal" has been used to refer to the transverse lateral or crosswise seal; the term "horizontal seal" to refer to the longitudinal or lengthwise seal at the outer edges opposite the folded packet bottom and the "top" of the packet to refer to the portion of the packet sealed by the horizontal or longitudinal seal. Thus, even though these portions of the packets are sometimes shown in the drawings oriented in non-vertical, non-horizontal, or other positions, the terms "vertical" and "horizontal" have been employed to simplify the description for those skilled in the art. In this same regard, it is also recognized that packaging operations may be carried out according to the invention with the transverse and longitudinal sealers operating and the seals being formed in orientations and positions different from those disclosed in the drawings. Thus, the embodiment described illustrates only one such orientation. The word "paper" has also been used in a generic sense to mean any packaging material suited to the invention. For example, while coated, heat settable paper has been mentioned, transparent polyethylene sheet material has also proven practical as an alternate method.

Finally, mention should be made that another important overall advantage achieved by the compact arrangement shown is that the length of the paper run between the supply roll 40 and the knife cutter 370 is substantially less than that obtained in prior art packagers. This reduction in turn leads to substantial reduction in time required to rethread and in number of potential breakdown points. Overall, the invention provides a vastly improved packaging apparatus and method.

What is claimed is:

1. In an apparatus for dividing fluid material into uniform units and for packaging the units, which includes:

a. a hollow cylindrical filling drum containing a volume of fluid material to be dispensed in discrete units;

b. a plurality of uniformly spaced and circularly arranged metering trap chambers formed on the periphery of said drum for rotation as an integral filling structure around a central horizontal axis, each chamber providing at least one open non-linear elongated fluid material flow path extending between an inlet communicating with the interior of said drum and an outlet laterally displaced along said flow path;

c. means for rotating said filling structure at a uniform predetermined speed and in a constant direction around said central axis, each chamber being adapted on each rotation and at said speed to communicate its respective inlet with the interior of said drum at a first rotative station, to receive a portion of said fluid material into said flow path, to discharge through said inlet as said chamber rotates away from said first station all except a quantity equal to one unit of said material, and to guide said unit along said flow path towards said outlet under the influence of the rotative forces asserted thereon as said chamber rotates at said speed towards a second rotative station whereby said unit is discharged from said outlet during passage of said chamber past said second station;

d. material supply means including a storage receptacle containing a volume of said material, conveyor means arranged to convey said material from said receptacle to said drum and leveling means independently controlling said conveyor means whereby said conveyor means may operate independently of said drum and being effective to operate said conveyor means intermittently as required to maintain a predetermined level of material in said container;

the improvement, comprising:

e. a source in folded heat-sealable strip form of transversely sealed packets;

f. means to guide and continuously move said strip of transversely sealed packets to and around a portion of said drum and in synchronism with the presence of said outlets at said second station wherein each said packet may receive and retain a said unit of material and then be moved to a longitudinal sealing station; and g. longitudinal sealing means at said longitudinal sealing station including a longitudinal sealer and means to tension said strip while passing through said longitudinal sealer, said longitudinal sealer comprising a pair of electrically heated laterally spaced bars adapted to receive and longitudinally seal the tops of said packets as the same are passed through and between said bars, said bars providing opposed parallel rectangular heating surfaces having plural changes in direction of curvature from end to end and adapted to cause said packet tops to follow an undulating path during longitudinal sealing thereof whereby the top portions of the opposite external sides of said packet are alternately contacted and heated during said longitudinal sealing.

2. In an apparatus as claimed in claim 1 including packet-opening means located at a packet-opening position proximate and above said second station, said opening means comprising a pair of spaced blocks providing opposed surfaces between which the unsealed top edge portions of said packets may be drawn, said surfaces having a plurality of openings adapted to discharge air and produce an air-suction effect and means to convey pressurized air to said surfaces for discharge through said surface openings to cause said edge portions to be sucked outwardly and said packets opened for filling prior to said second station.

3. In an apparatus as claimed in claim 1 wherein said source includes electrically heated transverse sealing means having a peripherally spaced circular array of electrically heated bars oriented transverse of the strip and continuously rotating around a central axis and over which said strip passes and is transversely sealed to form said packets and wherein said strip contains registration marks, powered roll means in the path of said strip and adapted to receive, tension and pull said strip during said transverse sealing and registration control means having means to detect said marks, means to control the speed of said powered roll means relative to that of said transverse sealing means and drift said strip on said transverse sealing means in either direction prior to being transversely sealed to maintain the appropriate registration of said seals.

* * * * *